US010850750B2

(12) United States Patent
Anderson et al.

(10) Patent No.: US 10,850,750 B2
(45) Date of Patent: Dec. 1, 2020

(54) VEHICLE DRAFT KEY WEAR PROTECTOR

(71) Applicant: Standard Car Truck Company, Rosemont, IL (US)

(72) Inventors: John D. Anderson, Oswego, IL (US); Walter J. Peach, Montgomery, IL (US); Brandon Colby Ennis, Graysville, AL (US); Benjamin Austin Myers, Fultondale, AL (US)

(73) Assignee: STANDARD CAR TRUCK COMPANY, Rosemont, IL (US)

( * ) Notice: Subject to any disclaimer, the term of this patent is extended or adjusted under 35 U.S.C. 154(b) by 265 days.

(21) Appl. No.: 15/894,319

(22) Filed: Feb. 12, 2018

(65) Prior Publication Data

US 2019/0009802 A1 Jan. 10, 2019

Related U.S. Application Data

(60) Provisional application No. 62/528,470, filed on Jul. 4, 2017.

(51) Int. Cl.
*B61G 9/24* (2006.01)
*B61G 9/20* (2006.01)

(52) U.S. Cl.
CPC *B61G 9/24* (2013.01); *B61G 9/20* (2013.01)

(58) Field of Classification Search
CPC ... B61G 7/00; B61G 7/14; B61G 9/00; B61G 9/20; B61G 9/22; B61G 9/24
See application file for complete search history.

(56) References Cited

U.S. PATENT DOCUMENTS

| | | | | |
|---|---|---|---|---|
| 3,718,264 | A * | 2/1973 | Norman, Jr. | B61G 7/10 213/50.5 |
| 3,802,577 | A | 4/1974 | Niggemeier et al. | |
| 4,042,117 | A | 8/1977 | McClurg | |
| 4,784,068 | A | 11/1988 | Burke | |
| 4,795,007 | A | 1/1989 | Murphy et al. | |
| 4,913,062 | A | 4/1990 | Burke | |
| 4,917,021 | A | 4/1990 | Murphy | |
| 5,112,178 | A | 5/1992 | Overhues et al. | |

(Continued)

FOREIGN PATENT DOCUMENTS

| | | |
|---|---|---|
| EP | 1090826 | 4/2001 |
| KR | 20-1998-0059800 | 11/1998 |

OTHER PUBLICATIONS

Korean Intellectual Property Office, Acting as International Searching Authority, International Search Report and Written Opinion in co-pending PCT/US2018/040708, dated Dec. 21, 2018 (13 pages).

(Continued)

*Primary Examiner* — Robert J McCarry, Jr.
(74) *Attorney, Agent, or Firm* — McCoy Russell LLP

(57) ABSTRACT

Various embodiments include a vehicle draft key wear protector including a first arm, a second arm spaced-apart from the first arm, a first connector integrally connected to the first arm and integrally connected to the second arm, and a second connector integrally and detachably connected to the first arm and integrally and detachably connected to the second arm, wherein the railroad car draft key wear protector is configured to be positioned on an uninstalled draft key, and is configured to be positioned on an installed draft key in situ.

17 Claims, 15 Drawing Sheets

(56) References Cited

U.S. PATENT DOCUMENTS

| | | | |
|---|---|---|---|
| 5,598,936 | A | 2/1997 | Murphy |
| 5,682,964 | A | 11/1997 | Murphy |
| 5,975,818 | A | 11/1999 | Burke et al. |
| 6,142,082 | A | 11/2000 | Burke et al. |
| 6,367,590 | B1 | 4/2002 | Burke |
| 6,467,853 | B1 | 10/2002 | Swartzendruber et al. |
| 6,708,625 | B1 | 3/2004 | Burke et al. |
| 6,786,160 | B1 | 9/2004 | Peach et al. |
| 7,780,021 | B2 | 8/2010 | Forbes |
| 7,784,150 | B2 | 8/2010 | Anderson et al. |
| D742,788 | S | 11/2015 | Burke et al. |
| 9,193,366 | B2 | 11/2015 | Forbes |
| 9,863,172 | B2 | 1/2018 | Burke et al. |
| 2017/0166225 | A1 | 6/2017 | Schoedl et al. |

OTHER PUBLICATIONS

Wabtec Corporation, Freight Car Draft Arrangements, Student Workbook TP2009, Feb. 2003 (21 pages).
International Bureau of WIPO, International Preliminary Report on Patentability Issued in Application No. PCT/US2018/040708, dated Jan. 7, 2020, WIPO, 9 pages.

* cited by examiner

VEHICLE DRAFT KEY WEAR PROTECTOR

PRIORITY

This application claims priority to and the benefit of U.S. Provisional Patent Application No. 62/528,470, filed Jul. 4, 2017, the entire contents of which are incorporated herein by reference.

BACKGROUND

Conventional freight railroad cars in North America and other parts of the world typically include an elongated frame, a car body mounted on the frame, and two spaced apart trucks that support the frame. These conventional freight railroad car also typically include two draft sill and coupler assemblies mounted to opposite ends of the elongated frame (for connection to other railroad cars in a train). Each draft sill and coupler assembly typically includes a draft sill, a coupler, and a draft key that connects the coupler to the draft sill.

One such conventional freight railroad car is generally shown in FIG. 1, and one such draft sill and coupler assembly is generally shown in more detail in FIGS. 2, 3, and 4. The freight railroad car 10 includes an elongated frame 12, an elongated body 14 mounted on the frame 12, and two spaced apart trucks 16 and 18 that support the frame 12 and the body 14. Each of the trucks 16 and 18 includes multiple wheels (not labeled) that are configured to roll along railroad tracks or rails (not labeled) in a conventional manner. The freight railroad car 10 includes multiple additional conventional components that are not shown or described herein, but will be understood to be present in a freight railroad car such as freight railroad car 10. The freight railroad car 10 includes two draft sill-coupler assemblies 40 and 50 mounted at opposite ends of the elongated frame 12. The draft sill and coupler assemblies 40 and 50 are typically identical and thus only draft sill and coupler assembly 50 is described in further detail.

As shown in more detail in FIGS. 2, 3, and 4, the draft sill-coupler assembly 50 generally includes: (1) a center sill 52 suitably attached to the frame 12; (2) a draft gear 60 supported by the center sill 52; (3) a follower block 62 supported by the center sill 52; (4) a yoke 64 supported by the center sill 52; (5) a coupler 70 extending into the yoke 64; (6) a draft key 80 that partially maintains the coupler 70 in the yoke 64; and (7) a suitable draft key retaining mechanism (not shown) that maintains the draft key 80 in the sill 52, yoke 64, and coupler 70. These components are well known in the railroad industry and to people of ordinary skill in the art and are thus not described in further detail herein except in relation to the draft key 80 and the sill 52.

The draft key 80 generally includes an elongated body 82 and a head 90 integrally connected to the body 82. The body 82 includes two opposing ends 84 and 86. The head 80 is integrally connected to the end 86 of the body 82 (opposite the free end 84 of the body 82). The body 82 of the draft key 80 has a generally oval cross-section, and the head 90 of the draft key 80 has a generally larger oval cross-section. In other words, the head 90 is larger than the body 82 both in height (i.e., from top to bottom) and in width (i.e., from side to side) as best shown in FIG. 4.

The elongated body 82 of the draft key 80 is configured to extend transversely through: (1) a first oblong opening 54 defined by a first side wall 53 of the sill 52 (as shown in FIG. 4); (2) a first oblong opening (not shown) defined by a first side wall (not shown) of the yoke 64; (3) through a transverse oblong opening (not shown) defined by the coupler 70; (4) a second oblong opening 67 defined by second side wall 66 of the yoke 64 (as shown in FIG. 3); and (5) a second oblong opening 56 defined by second side wall 55 of the sill 52 (as shown in FIG. 2). The end 84 of the body 82 of the draft key 80 is a free end configured to extend out of a second side wall 66 of the yoke 64 (as shown in FIG. 3) and out of the second side wall 55 of the sill 52 (as shown in FIG. 2). A suitable retaining mechanism (mentioned above but not shown) prevents the draft key 80 from backing out of the sill 52, the yoke 64, and the coupler 70 as is well known in the railroad industry.

The draft key 80 is configured to hold the coupler 70 in engagement in the center sill 52 and yoke 64. The head 90 of the draft key 80 prevents the draft key 80 from moving to far through the sill 52, the yoke 64, and the coupler 70. The sill 52, the yoke 64, and the coupler 70 are configured such that the draft key 80 can move forwardly and rearwardly (in the direction of the movement of the trucks and railroad car) in the oblong openings 54 and 56 of the sill 52, and in the oblong openings of the yoke 64, in the oblong opening of the coupler 70 during the coupling processes and during movement of the train as is well known in the railroad industry. As generally indicated by FIG. 4, the draft key 80 and specifically the head 90 of the draft key 80: (a) moves forwardly and rearwardly (in slot 54 defined by the side wall 53 of the sill 52) during coupling and decoupling process of the railroad car 10 with another adjacent railroad car; (b) moves forwardly and rearwardly (in slot 54 defined by the side wall 53 of the sill 52) during movement of the railroad cars; and (c) tends to vibrate during movement of the railroad cars. Thus, the head 90 of the draft key 80 moves and vibrates with relative to the side wall 53 of the sill 52 at numerous points in time during the operation of the railroad car 10. As the head 90 moves forwardly and rearwardly in slot 54 the inner surface (not labeled) of the head 90 engages the rim 57 of the side wall 53 of the sill 52 that defines the opening 54. This engagement causes wear on the rim 57 as generally shown in FIG. 4. This wear can weaken the sill 52 and can cause the sill 52 to develop one or more stress cracks. This wear can thus cause the sill 52 to be replaced.

One remedy for this has been to build up the worn area with welded material. This is relatively time consuming and expensive.

This problem is further complicated because such draft sill and coupler assemblies are widely used on hundreds of thousands (if not millions) of railroad cars that are in service.

SUMMARY

Various embodiments of the present disclosure provide a railroad car draft key wear protector that reduces or eliminates the wear caused by the head of a draft key on a sill of a railroad car. In various embodiments of the present disclosure, the draft key wear protector can be quickly and easily mounted on a draft key before the draft key is inserted into a sill, a yoke, and a coupler during an assembly process, and can alternatively be quickly and easily mounted on an draft key that is already positioned in a sill, a yoke, and a coupler without having to remove the draft key from the sill, the yoke, and the coupler (on sight in situ).

Various embodiments of the present disclosure a railroad car draft key wear protector including a first arm, a second arm spaced-apart from the first arm, a first connector integrally connected to the first arm and integrally connected to the second arm, and a second connector integrally and detachably connected to the first arm and integrally and detachably connected to the second arm. Various embodiments of the railroad car draft key wear protector are configured to be positioned on an uninstalled draft key, and also are configured to be positioned on an installed draft key in situ. In the mounted position, the draft key wear protector is mounted between the head of the draft key and the rim extending from the first side wall of the sill. As the draft key moves inwardly and outwardly and forwardly and rearwardly and during the relative movement of the attached railroad cars, the draft key wear protector prevents contact between the head of the draft key and the rim, thus reducing wear on the head of the draft key and the rim extending from the first side wall of the sill. This reduces the likelihood that the sill will develop one or more stress cracks, and reduces the likelihood that the sill will need to be replaced. This also reduces the need for the worn area to be built up with welded material and thus reduces relatively time consuming and expensive maintenance.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
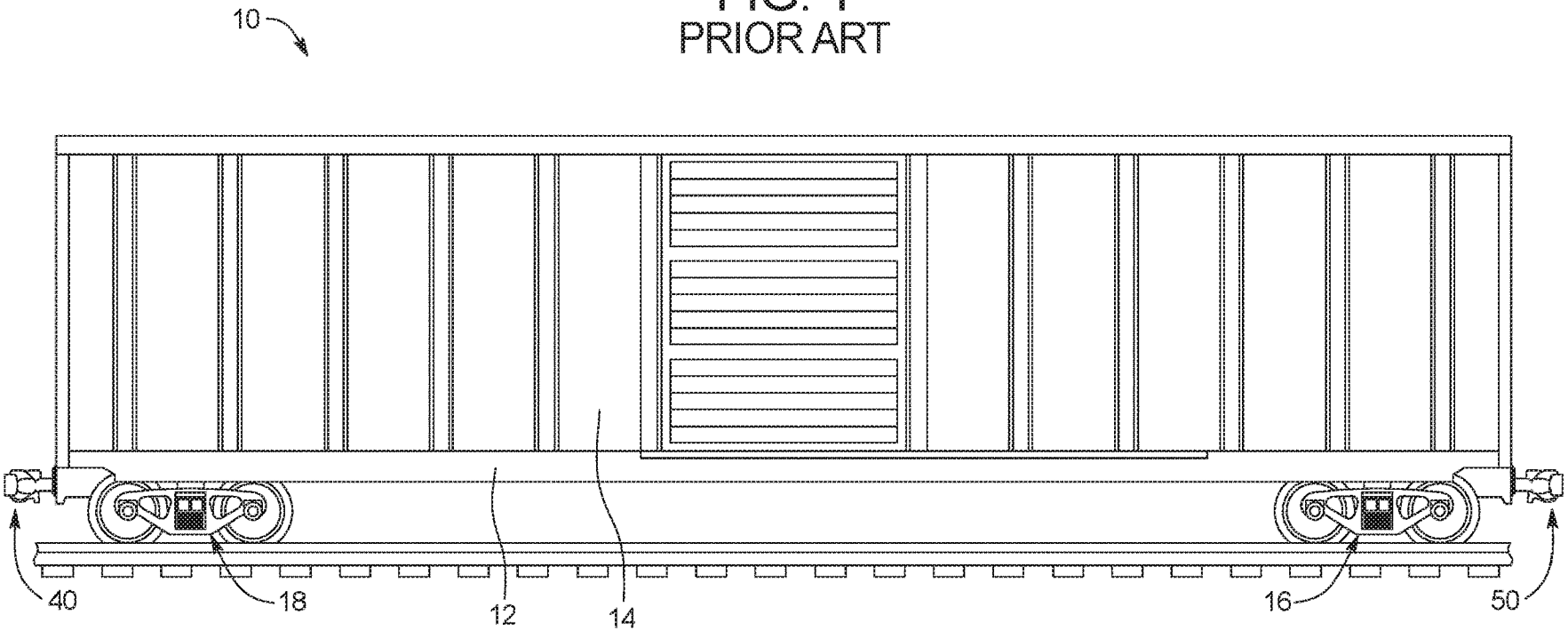
FIG. 1 PRIOR ART
FIG. 1 is a side view of an example known freight railroad car positioned on railroad tracks or rails.
Figure 2:
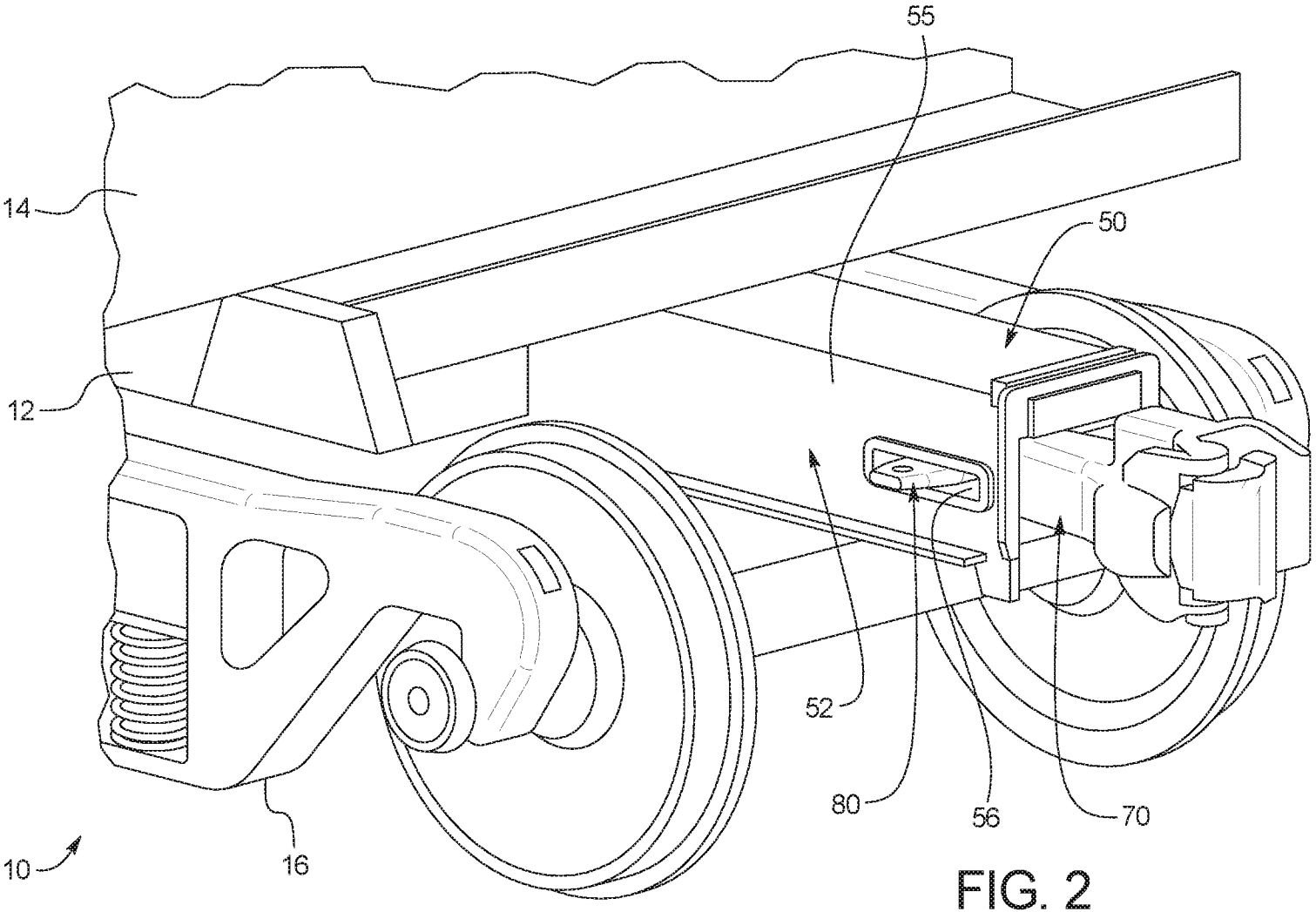
FIG. 2 PRIOR ART
FIG. 2 is an enlarged fragmentary view of one end of the known freight railroad car of FIG. 1, and showing the draft sill and coupler assembly including the center sill, the coupler, and the draft key thereof.
Figure 3:
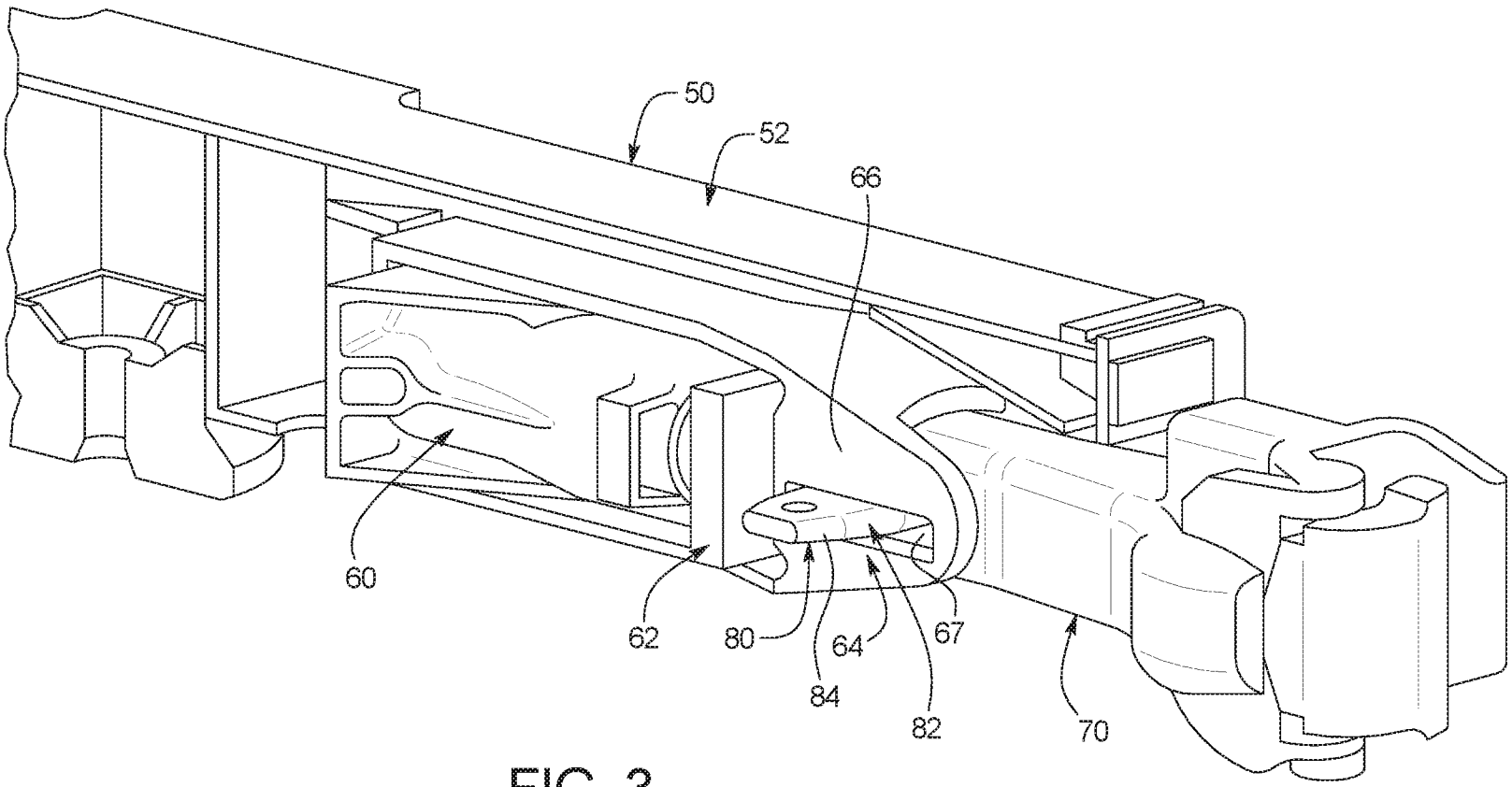
FIG. 3 PRIOR ART
FIG. 3 is an enlarged fragmentary partial perspective and partial cross-sectional view of one end of the known freight railroad car of FIG. 1, and showing the draft sill and coupler assembly including the center sill, the draft gear, the follower block, the yoke, the coupler, and the draft key thereof.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, attached, connected, and the like, are not intended to be limited to direct mounting methods but should be interpreted broadly to include indirect and operably mounted, attached, connected and like mounting methods. This specification is intended to be taken as a whole and interpreted in accordance with the principles of the present disclosure and as understood by one of ordinary skill in the art.

Referring now to FIGS. 5 to 11, one example embodiment of the draft key wear protector of the present disclosure is generally indicated by numeral 100. For brevity, the draft key wear protector of the present disclosure may sometimes be referred to herein as the key protector or the protector. It should be appreciated that such abbreviations are not meant to limit the scope of the present disclosure.

Figure 4:
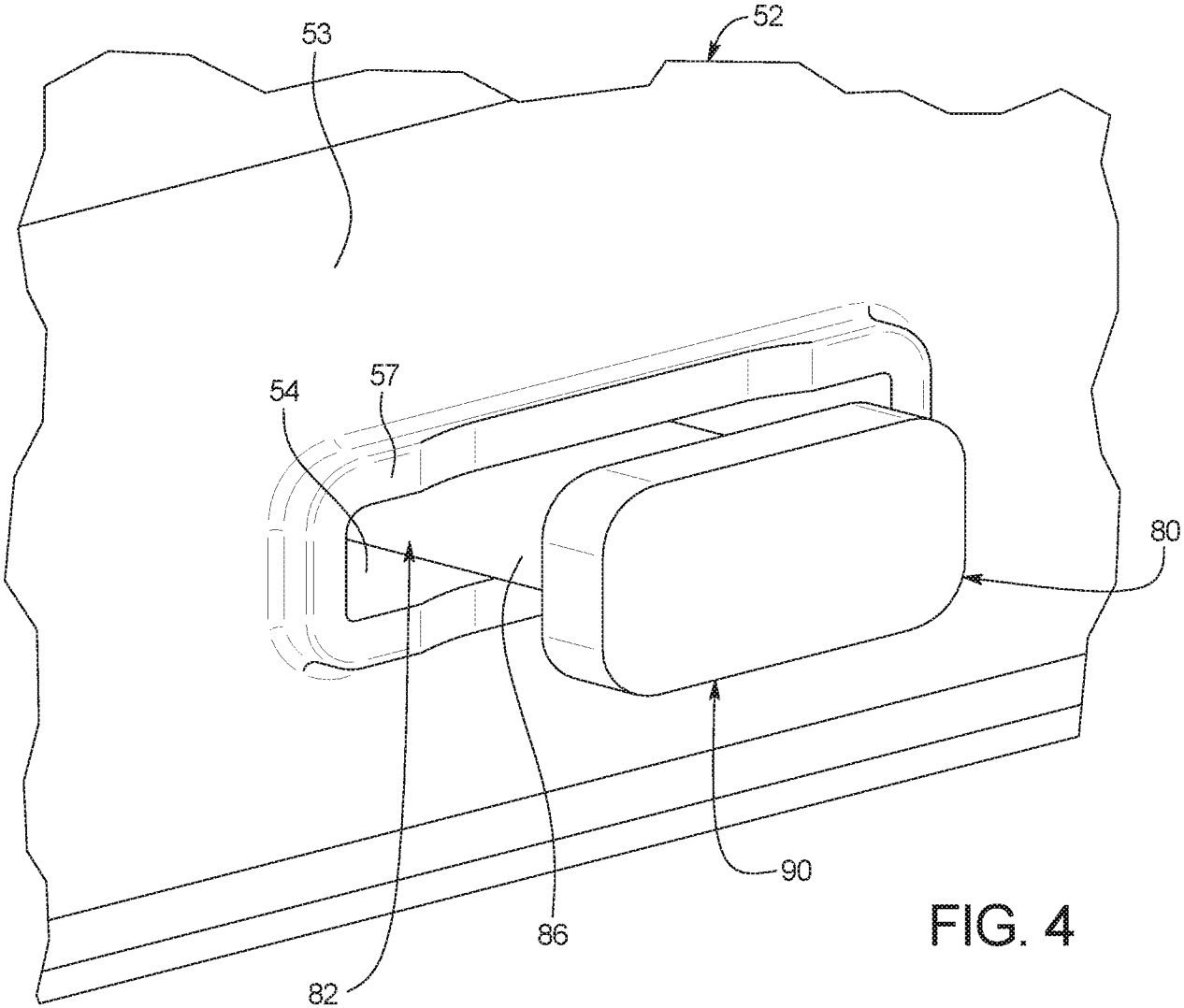
FIG. 4 is an enlarged fragmentary perspective view of a first side wall of the sill and the draft key of the draft sill and coupler assembly of FIGS. 2 and 3, and showing wear on the rim of the first side wall of the sill caused by the head of the draft key.
Figure 5:
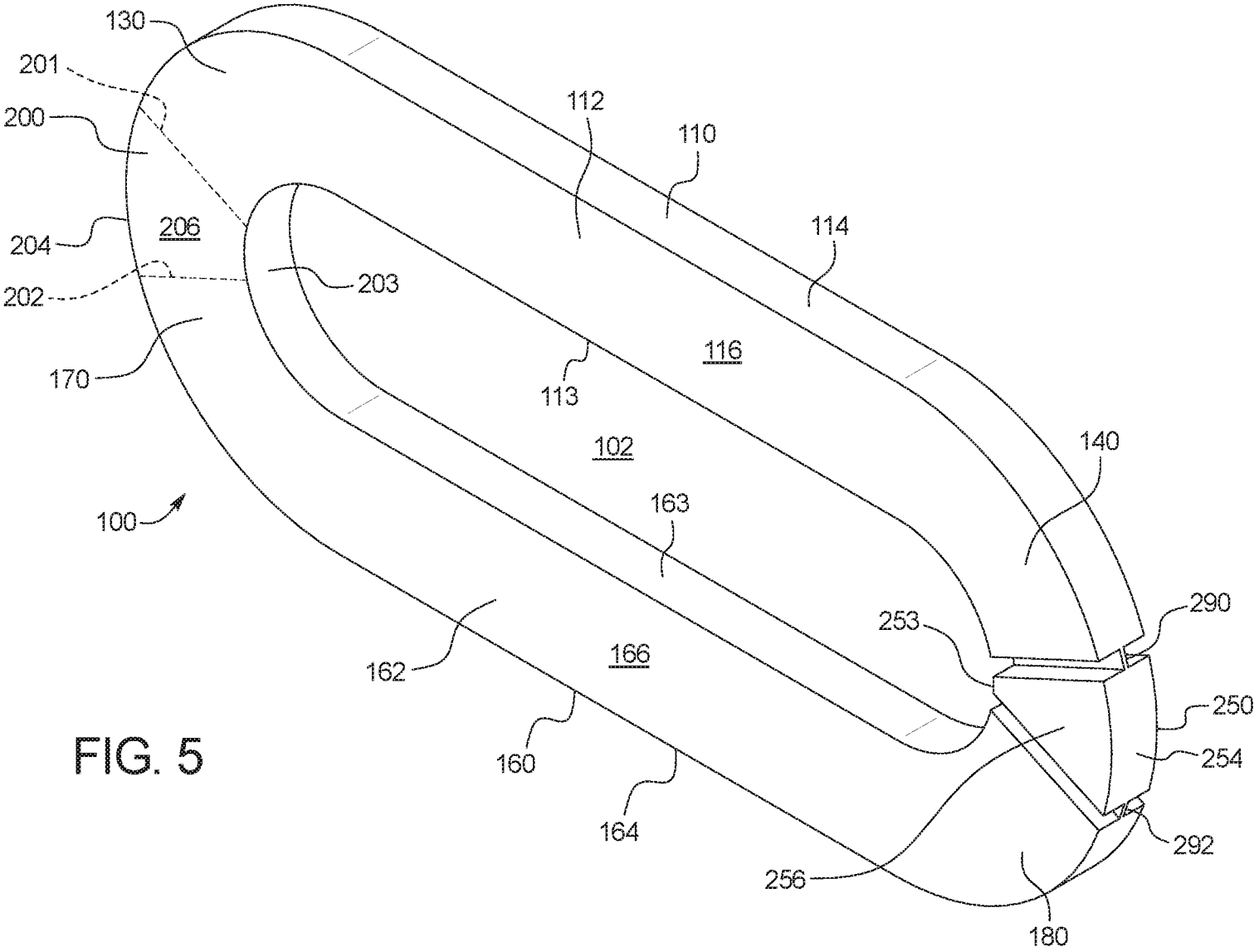
FIG. 5 is enlarged perspective view of a draft key wear protector of one example embodiment of the present disclosure, and showing the detachable arm connector attached to opposing arms of the draft key wear protector.
Figure 6:
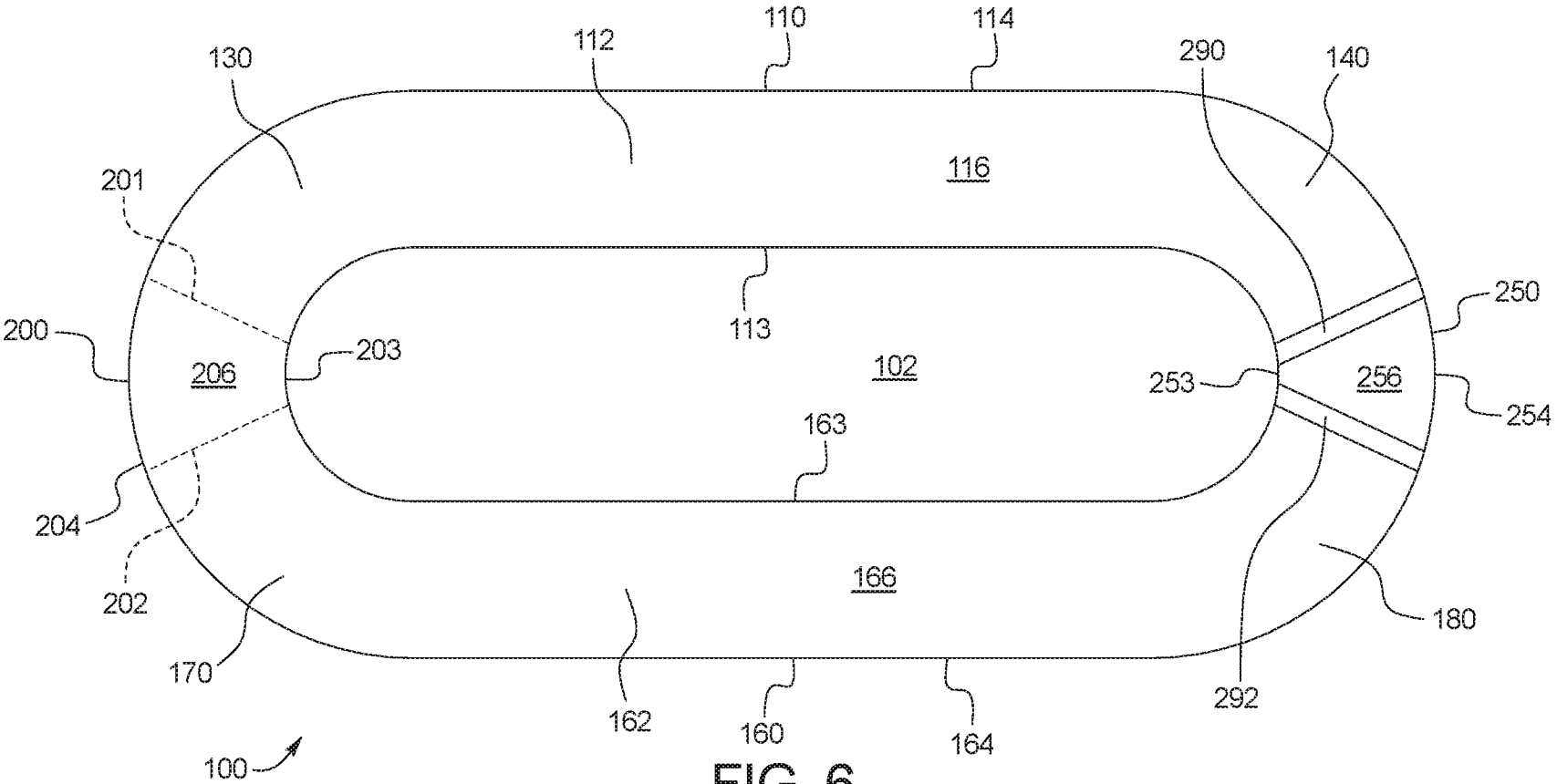
FIG. 6 is a side view of the draft key wear protector of FIG. 5, and showing the detachable arm connector attached to opposing arms of the draft key wear protector.
Figure 7:
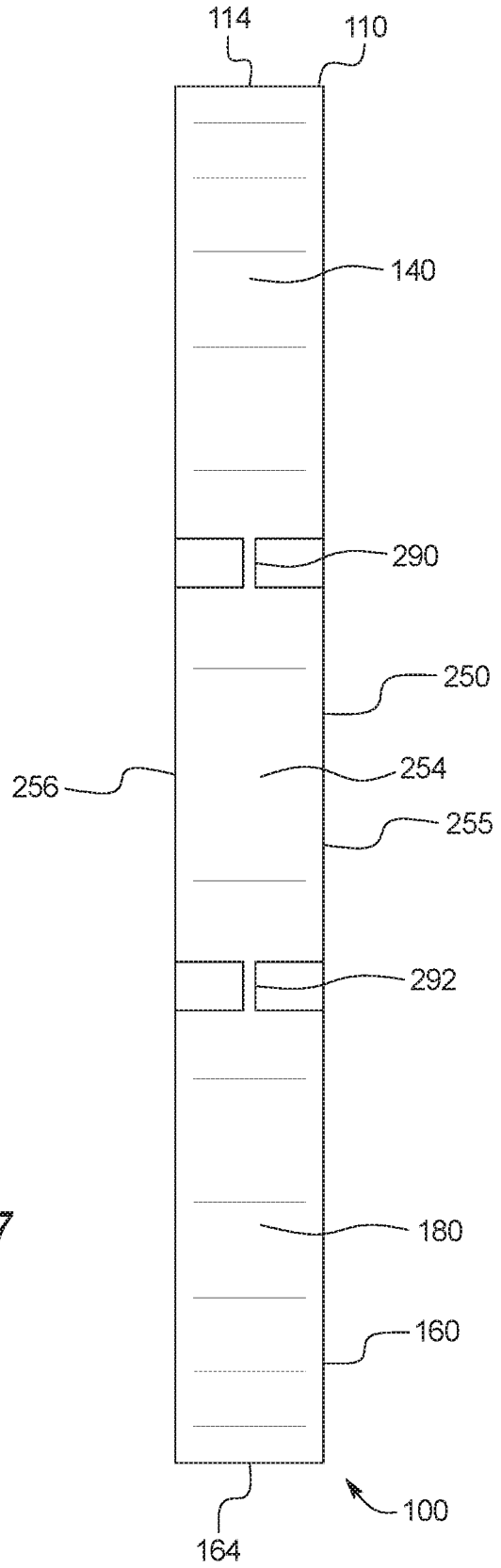
FIG. 7 is a first end view of the draft key wear protector of FIG. 5, and showing the detachable arm connector attached to opposing arms of the draft key wear protector.
Figure 9:
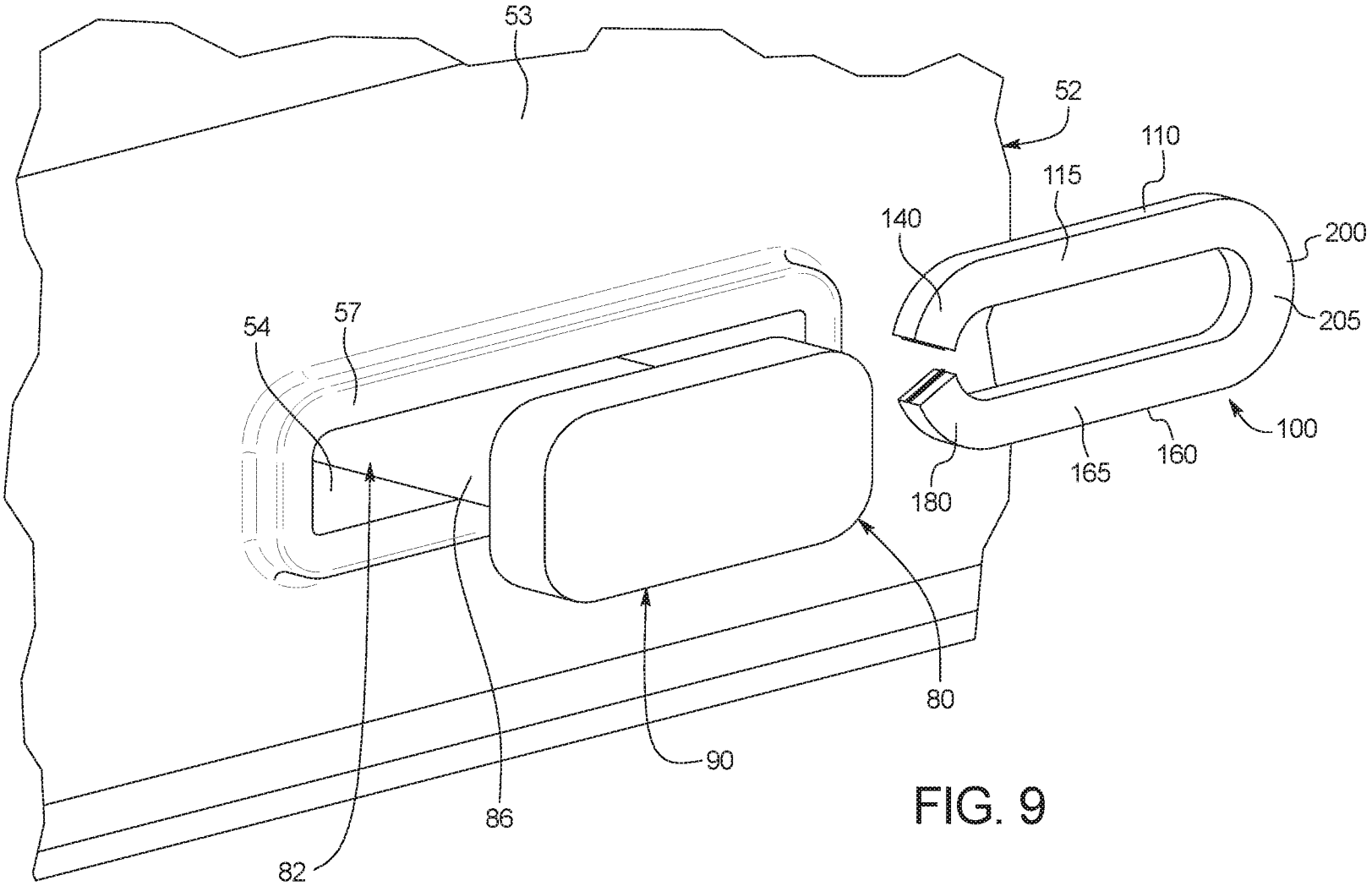
FIG. 9 is an enlarged fragmentary perspective view of a first side wall of the sill and the draft key of the draft sill and coupler assembly of FIGS. 2, 3, and 4, and a perspective view of the draft key wear protector of FIG. 5 positioned adjacent to the draft key prior to mounting on the draft key.
Figure 10:
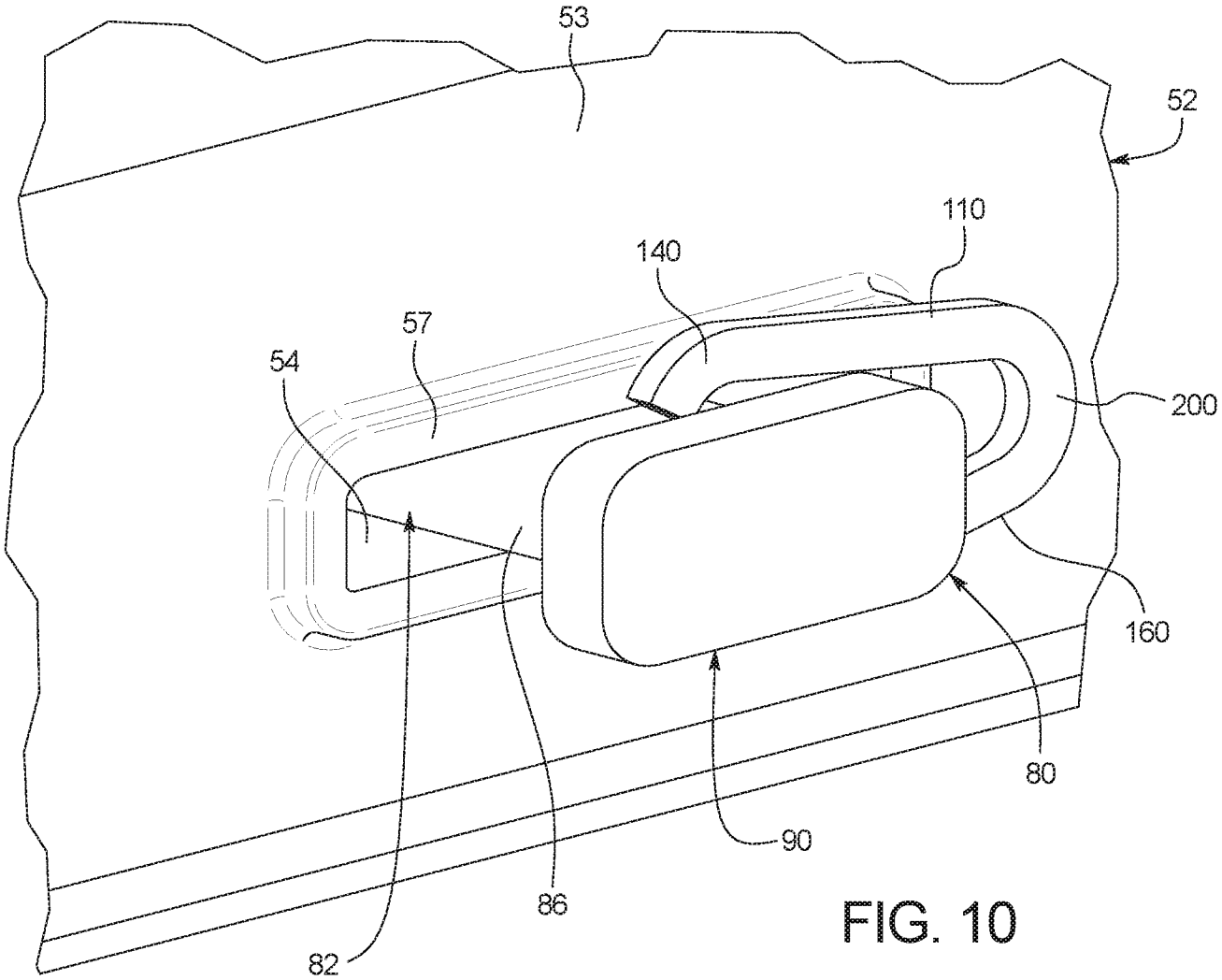
FIG. 10 is an enlarged fragmentary perspective view of a first side wall of the sill and the draft key of the draft sill and coupler assembly of FIGS. 2, 3, and 4, and a perspective view of the draft key wear protector of FIG. 5 positioned partially on the draft key during the mounting process.
Figure 11:
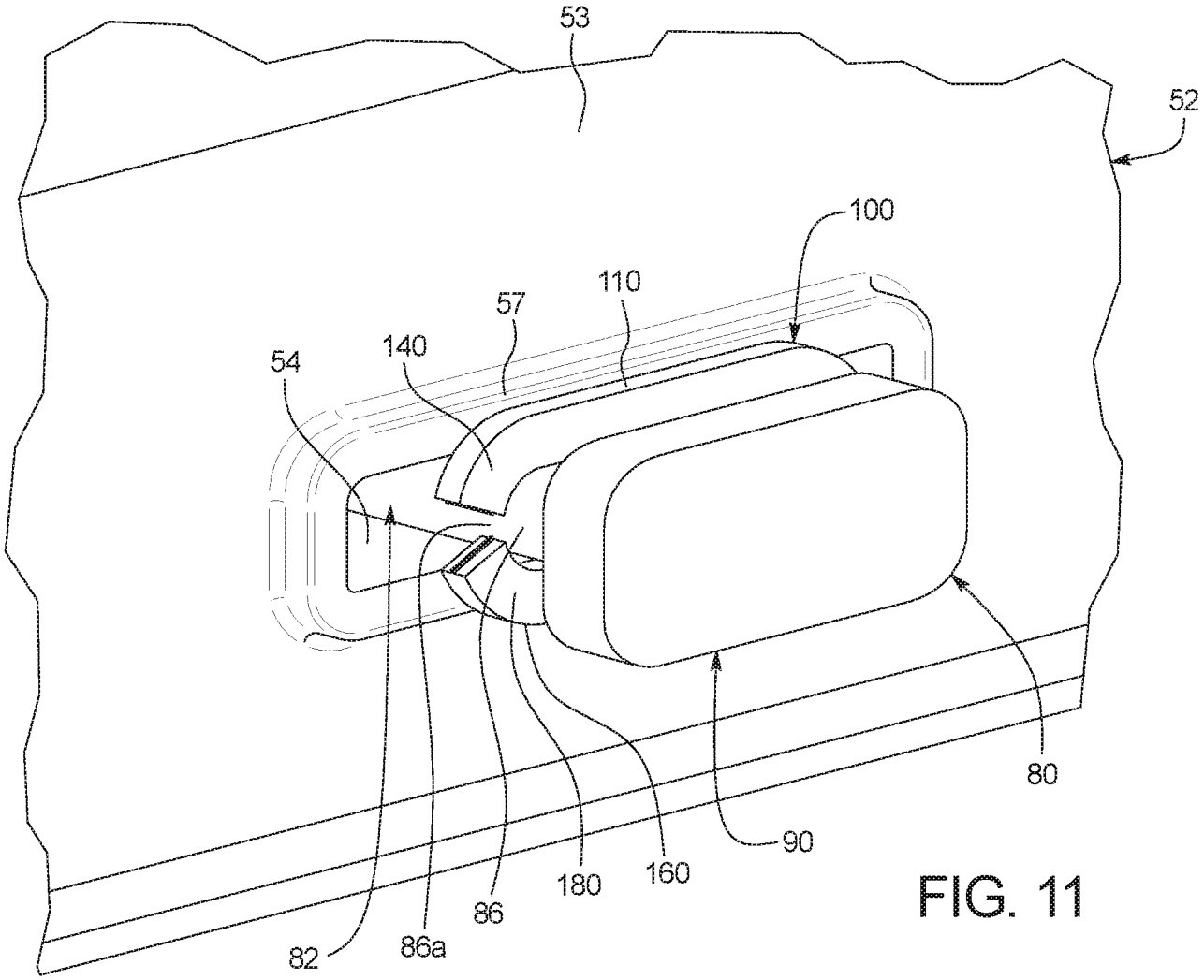
FIG. 11 is an enlarged fragmentary perspective view of a first side wall of the sill and the draft key of the draft sill and coupler assembly of FIGS. 2, 3, and 4, and a perspective view of the draft key wear protector of FIG. 5 mounted on the draft key after the mounting process.

The example draft key wear protector 100 includes an generally oval body including: (1) a first arm 110; (2) a second arm 160 spaced-apart from the first arm 110; (3) a first arm connector 200 integrally connected to the first arm 110 and integrally connected to the second arm 160; and (4) a second detachable arm connector 250 integrally but detachably connected to the first arm 110 and integrally but detachably connected to the second arm 160. In this illustrated example embodiment, the detachable second arm connector 250 is configured to be quickly and easily broken off from or detached from the first arm 110 and the second arm 160 to facilitate mounting of the wear protector 100 on an installed draft key such as the draft key 80 illustrated in FIG. 4 (without having to remove the draft key 80 from the center sill 55, the yoke 64, and the coupler 70) as shown in FIGS. 9, 10, and 11 and as further described below. In this illustrated example embodiment, the detachable second arm connector 250 is configured to remain attached to the first arm 110 and the second arm 160 for mounting of the wear protector 100 on an un-installed draft key prior to installation in a center sill 55, a yoke 64, and a coupler 70.

In this illustrated example embodiment, the first arm 110, the second arm 160, the first arm connector 200, and the second detachable arm connector 250 define a generally oval central opening 102. It should be appreciated that the shape and size of this opening may vary in accordance with the present disclosure.

More specifically, the first arm 110 includes an elongated generally straight section 112, a first curved hand 130 connected to and extending from one end of the straight section 112, and a second curved hand 140 connected to and extending from a second opposite end of the section 112. The first arm 110 has an inner surface 113, an outer surface 114, a first side surface 115 (see FIG. 9), and a second side surface 116.

Likewise, the second arm 160 includes an elongated generally straight section 162, a first curved hand 170 connected to and extending from one end of the straight section 162, and a second curved hand 180 connected to and extending from a second opposite end of the section 162. The second arm 160 has an inner surface 163, an outer surface 164, a first side surface 165 (se FIG. 9), and a second side surface 166.

The first connector 200 includes a generally wedge shaped body integrally connected on one end to the first arm 110 and integrally connected on the other end to the second arm 160. The ends of the first connector 200 are generally indicated by phantom lines 201 and 202 in this illustrated example embodiment; however, it should be appreciated that the positions of these ends may vary in accordance with the present disclosure. The first connector 200 includes an inner surface 203, an outer surface 204, a first side surface 205 (see FIG. 9), and a second side surface 206. It should be appreciated that the first connector does not need to be wedge shaped in accordance with the present disclosure and can thus have a suitable alternative shape.

The first connector 200 is integrally connected with the first curved hand 130 of the first arm 110 and the first curved hand 170 of the second arm 160. The configuration enables the first arm 110 and the second arm 160 to: (1) be spread apart without breaking during the mounting of the protector 100 on an installed draft key 80; and (2) then return to their normal unbiased positions after mounting of the protector 100 on an installed draft key 80, as shown in FIGS. 9, 10, and 11 and as further discussed below.

The detachable second connector 250 includes a generally wedge shaped body integrally connected on one end to the first arm 110 and integrally connected on the other end to the second arm 160. The second connector 250 includes an inner surface 253, an outer surface 254, a first side surface 255, and a second side surface 256. It should be appreciated that the second connector does not need to be wedge shaped in accordance with the present disclosure and can thus have a suitable alternative shape.

Figure 8:
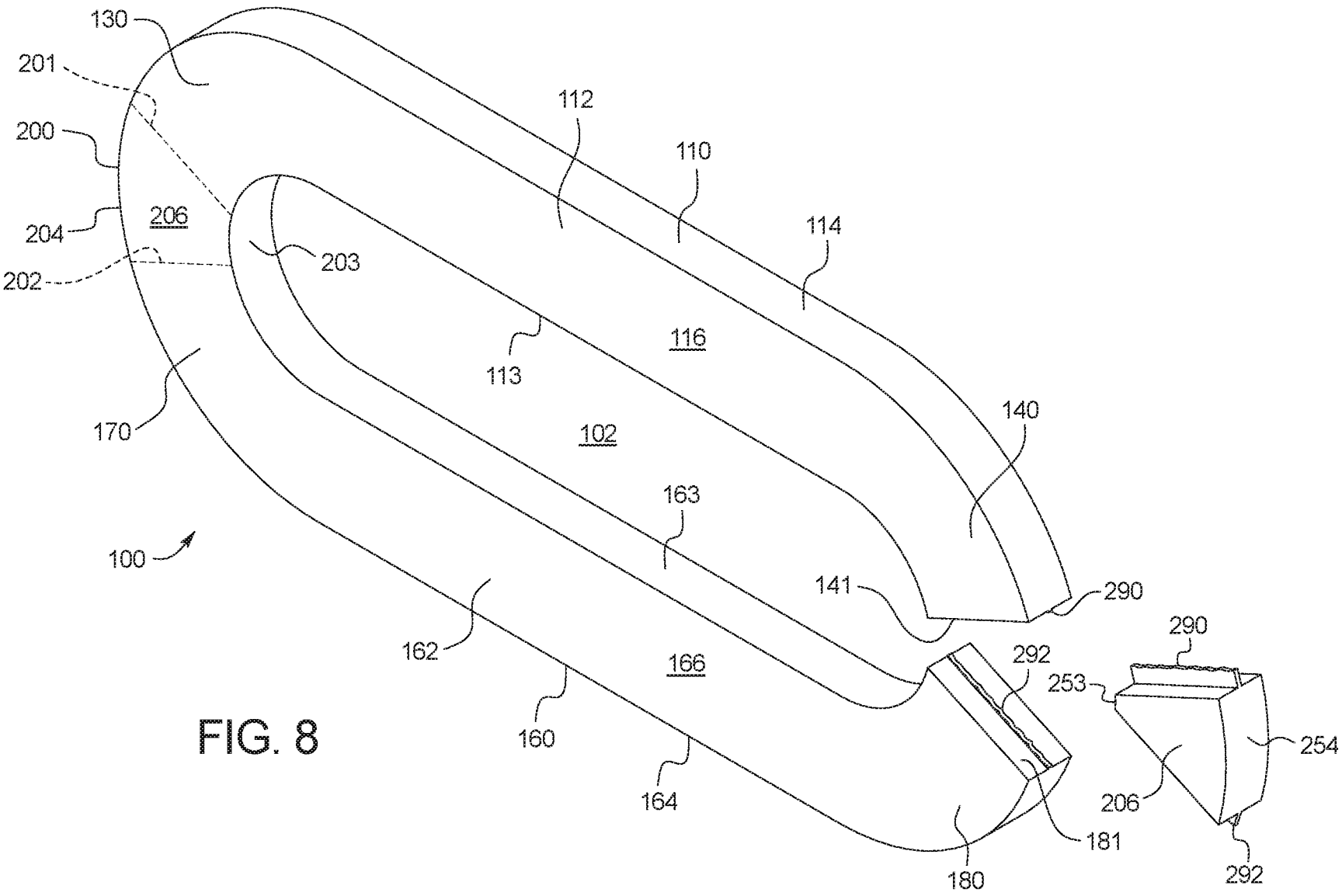
FIG. 8 is an enlarged exploded perspective view of the draft key wear protector of FIG. 5, and showing the detachable arm connector detached from the opposing arms of the draft key wear protector.

The detachable second connector 250 is integrally connected with the second hand 140 of the first arm 110 by a first joint 290 and is integrally connected with the second curved hand 180 of the second arm 160 by a second joint 292. The first joint 290 has a substantially narrower width than: (1) the width of the detachable second connector 250; (2) the width of the second hand 140; and (3) the width first arm 110, (which all have the same width in this illustrated example embodiment). Likewise, the second joint 292 also has a substantially narrower width than: (1) the width of the detachable second connector 250; (2) the width of the second hand 180; and (3) the width second arm 160, (which all have the same width in this illustrated example embodiment). This configuration enables the detachable second connector 250 to be quickly and easily detached from the first arm 110 and the second arm 160 for mounting on an installed draft key 80 as shown in FIGS. 9, 10, and 11 and as further discussed below. It should be appreciated that this detachable second connector 250 can be detached from the first arm 110 and the second arm 160 in any suitable manner such as by hand or by using a suitable tool (such as a hammer or pair of pliers). After the detachable second connector 250 is detached from the first arm 110 and the second arm 160, the first arm 110 and the second arm 160 can be biased and spread apart and mounted on an installed draft key 80 as shown in FIGS. 9, 10, and 11 and as further discussed below. After the detachable second connector 250 is detached from the first arm 110 and the second arm 160, the first arm 110 and the second arm 160 have inclined or angled surfaces or walls 141 and 181 (as generally shown in FIGS. 8 and 9) that are configured to engage the body of the draft key during installation to assist in spreading the first and second arms 110 and 160 apart during installation of the draft key wear protector 100 on the draft key. In this illustrated example embodiment, the inclined surfaces 141 and 181 extend in planes that are transverse to each other. In this illustrated example embodiment, the inclined surfaces 141 and 181 extend at approximately fifty degree angles with respect to each other; however, it should be appreciated that this angle may vary in accordance with the present disclosure. The inclined surfaces enable the draft key wear protector 100 to be at least partially self-spreading upon engagement with the body of the draft key.

It should further be appreciated (as mentioned above) that the detachable second connector 250 does not need to be detached from the first arm 110 and the second arm 160 when the draft key wear protector 100 is mounted on a draft key 80 that is to be subsequently inserted into a center sill 55, a yoke 64, and a coupler 70. In such situations, prior to the insertion of the draft key 80 in a center sill 55, a yoke 64, and a coupler 70, the draft key wear protector 100 (with the attached detachable connector 250) is slid over the free end 84 of the body 82 of the draft key 80 and moved to the opposing end 86 of the body 82 adjacent to the head 90. The draft key 80 with the draft key wear protector 100 mounted thereon can then be inserted into a center sill 55, a yoke 64, and a coupler 70 and secured in place by a draft key retaining mechanism (not shown). It should thus be appreciated that the draft key wear protector 100 of this illustrated example embodiment is thus configured to be employed in situations where the draft key 80 is installed (and without removing the draft key 80) and in situations where the draft key 80 will subsequently be installed. Thus, users of the draft key wear protector of the present disclosure only need to keep a single supply of draft key wear protectors on hand for both situations, which saves on inventory control time, inventory expense, and installer training.

In various embodiments, the draft key wear protector of the present disclosure is made from an ultra high molecular weight polyethylene (commonly called UHMW) or another suitable thermoplastic polyethylene. In various embodiments, the draft key wear protector of the present disclosure includes glass filled material. In various embodiments, the draft key wear protector of the present disclosure includes glass filled UHMW. In various embodiments, the draft key wear protector of the present disclosure includes a UV inhibitor. In various embodiments, the draft key wear protector of the present disclosure includes UHMW with a UV inhibitor. In various embodiments, the draft key wear protector of the present disclosure includes glass filled UHMW with a UV inhibitor. It should be appreciated that the draft key wear protector of the present disclosure can be made from other suitable materials. In various embodiments, the draft key wear protector of the present disclosure is molded. It should be appreciated that the draft key wear protector of the present disclosure can be made in other suitable manners. In various embodiments, the draft key wear protector of the present disclosure is made from highly wear resistant and impact resistant material.

As mentioned above, FIGS. 9, 10, and 11 illustrate the mounting of the draft key wear protector 100 on an installed draft key 80. More specifically, FIG. 9 illustrates the draft key wear protector 100 after the connector 250 has been detached from the arms 110 and 160, and positioned adjacent to an installed draft key 80. It should be appreciated that the draft key 80 extends far enough away from the first wall 53 of the sill 52 such that the draft key wear protector 100 can fit between the head 90 of the draft key 80 and the first wall 53 of the sill 52. In situations where the head 90 of the draft key 80 is engaging or is much closer to the first wall 53 of the sill 52, the installer can pry the head 90 outwardly or can push the opposite free end 84 of the body 82 of draft key 80 inwardly to create the needed room for the draft key wear protector 100. FIG. 10 illustrates the draft key wear protector 100 with the arms 110 and 160 biased or spread apart (by the installer) and partially positioned over the upper and lower surfaces of the end 86 of the body 82 of the draft key 80. FIG. 11 illustrates the draft key wear protector 100 after the arms 110 and 160 have returned to their normal positions and with the arms 110 and 160 positioned substantially around the end 86 of the body 82 of the draft key 80 such that the hands 140 and 180 engage the side edge 86*a* of the end 86 of the body 82 of the draft key to prevent the draft key wear protector 100 from slipping off of the draft key 80. The hands 140 and 180 of the draft key wear protector 100 function are or function as gripping hands in this illustrated example embodiment.

In the mounted position, the draft key wear protector 100 is mounted between the head 90 of the draft key 80 and the first side wall 53 of the sill 52, and more specifically between the head 90 of the draft key 80 and the rim 57 extending from the first side wall 53 of the sill 52. As the draft key 80 moves inwardly and outwardly and forwardly and rearwardly and during the relative movement of the attached railroad cars, the draft key wear protector 100 prevents contact between the head 90 of the draft key 80 and the rim 57 extending from the first side wall 53 of the sill 52, thus reducing wear on the head 90 of the draft key 80 and the rim 57 extending from the first side wall 53 of the sill 52. This reduces the likelihood that the sill 52 will develop one or more stress cracks, and reduces the likelihood that the sill 52 will need to be replaced. This also reduces the need for the worn area to be built up with welded material and thus reduces relatively time consuming and expensive maintenance.

It should also be appreciated that the inner surfaces and 113, 163, and 203 of the draft key wear protector 100 can engage the outer surfaces of the end 86 of the body 82 of the draft key 80. It should also be appreciated from this that the oval draft key wear protector 100 defines an opening that is slightly larger (i.e., slightly wider and slightly greater in height) than the end 86 of the body 82 of the draft key 80. It should also be appreciated that the size of the opening that the oval draft key wear protector 100 defines can vary in accordance with the present disclosure.

It should be appreciated that the dimensions of the draft key wear protector can vary in accordance with the present disclosure. The dimensions of the draft key wear protector may vary based on the dimensions of the draft key on which the draft key wear protector will be mounted. In various embodiments, the draft key wear protector of the present disclosure has a greater width and/or a greater height than the head of the draft key. In certain example embodiments, the draft key wear protector 100: (1) has a side to side thickness of an approximately 0.375 inches; (2) a top to bottom height of approximately 3.500 inches; (3) an arm height of approximately 0.900 inches; and (4) a joint thickness of approximately 0.03 inches.

FIGS. 9, 10, and 11 show the draft key wear protector 100 being mounted on the draft key 80 from the back end of the draft key. It should be appreciated that the draft key wear protector 100 can be mounted from the front end of the draft key 80. This assist in the ease of mounting.

It should also be appreciated that the draft key wear protector of the present disclosure (such as example draft key wear protector 100) can also be mounted on or adjacent to free end 84 of the body 82 of the draft key 80 to prevent contact between the retaining mechanism (not shown) and the side wall 55 of the sill 52.

Figure 12:
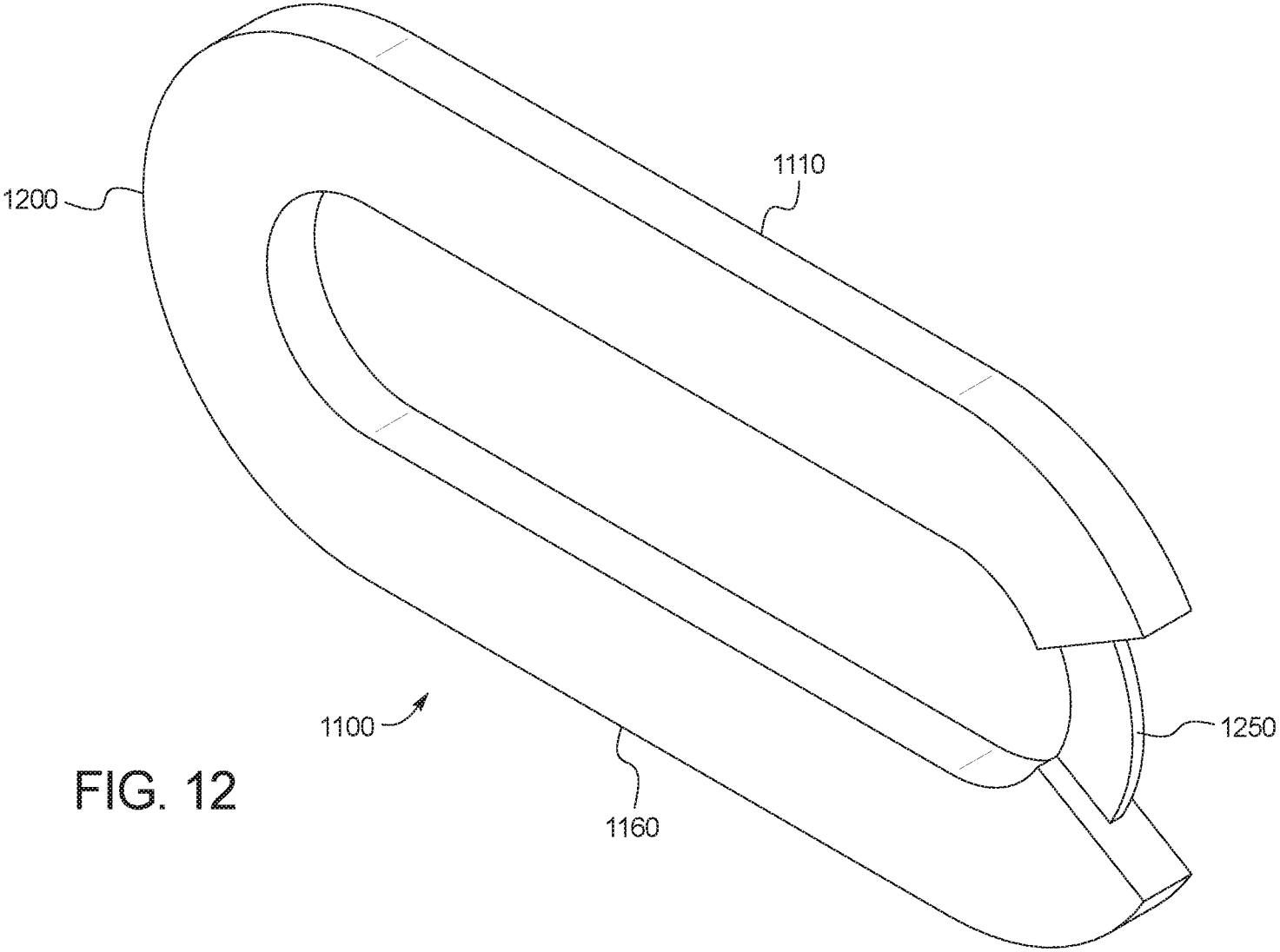
FIG. 12 is a perspective view of another example embodiment of the draft key wear protector of the present disclosure.

Referring now to FIG. 12, another example embodiment of the draft key wear protector of the present disclosure is generally indicated by numeral 1100. This example draft key wear protector 1100 includes a generally oval body including: (1) a first arm 1110; (2) a second arm 1160 spaced-apart from the first arm 1110; (3) a first arm connector 1200 integrally connected to the first arm 1110 and integrally connected to the second arm 1160; and (4) a second detachable arm connector 1250 integrally but detachably connected to the first arm 1110 and integrally but detachably connected to the second arm 1160. The first arm 1110, the second arm 1160, and the first arm connector 1200 are identical to the first arm 110, the second arm 160, and the first arm connector 200 of draft key wear protector 100 in this illustrated example embodiment. The second detachable arm connector 1250 is different from the second detachable arm connector 250 of draft key wear protector 100. In this example illustrated embodiment, the entire second detachable arm connector 1250 is of one or more smaller dimensions (including a smaller thickness and/or a smaller width) than the second detachable arm connector 250 of draft key wear protector 100. The entire second detachable arm connector 1250 is configured to remain attached to the first arm 1110 and the second arm 1160 when this example draft key wear protector 1100 is positioned on an un-installed draft key, and can be quickly and easily detached before this example draft key wear protector 1100 is to be positioned on an installed draft key.

Figure 13:
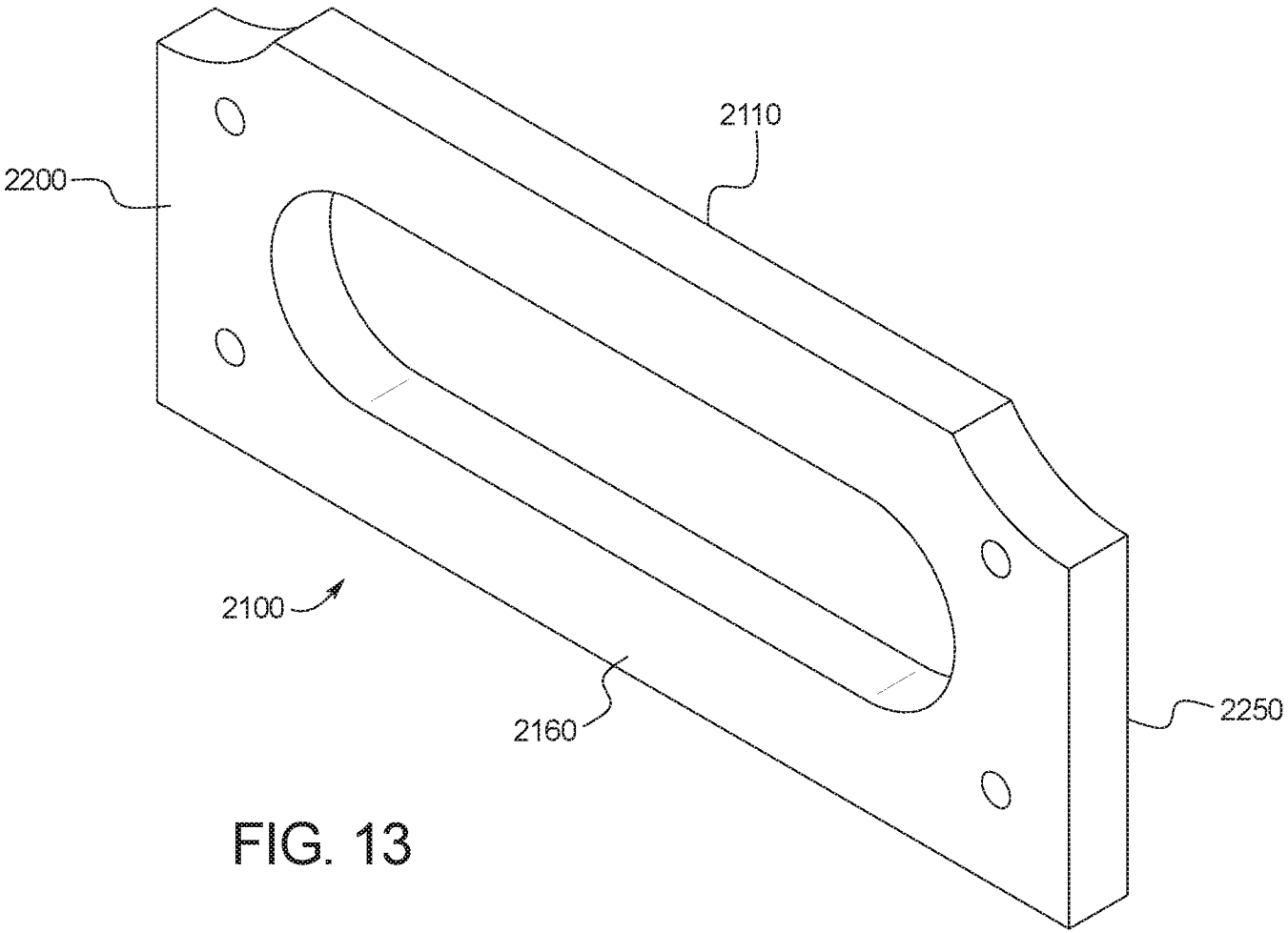
FIG. 13 is a perspective view of another example embodiment of the draft key wear protector of the present disclosure.

It should further be appreciated that in other example embodiments of the present disclosure, the draft key wear protector of the present disclosure does not include a detachable or attachable connector. For example, referring now to FIG. 13, another example embodiment of the draft key wear protector of the present disclosure is generally indicated by numeral 2100. This example draft key wear protector 2100 includes a generally rectangular body including: (1) a first arm 2110; (2) a second arm 2160 spaced-apart from the first arm 2110; (3) a first arm connector 2200 integrally connected to the first arm 2110 and integrally connected to the second arm 2160; and (4) a second arm connector 2250 integrally connected to the first arm 2110 and integrally connected to the second arm 2160. The second arm connector 2250 is configured to remain attached to the first arm 2110 and the second arm 2160 when this example draft key wear protector 1100 is positioned on an un-installed draft key. This example draft key wear protector 2100 can be positioned on an installed draft key (adjacent to the head of the draft key) by removing the draft key, positioning this draft key wear protector 2100 on the draft key adjacent to the head of the draft key, and then reinstalling the draft key.

Figure 14:
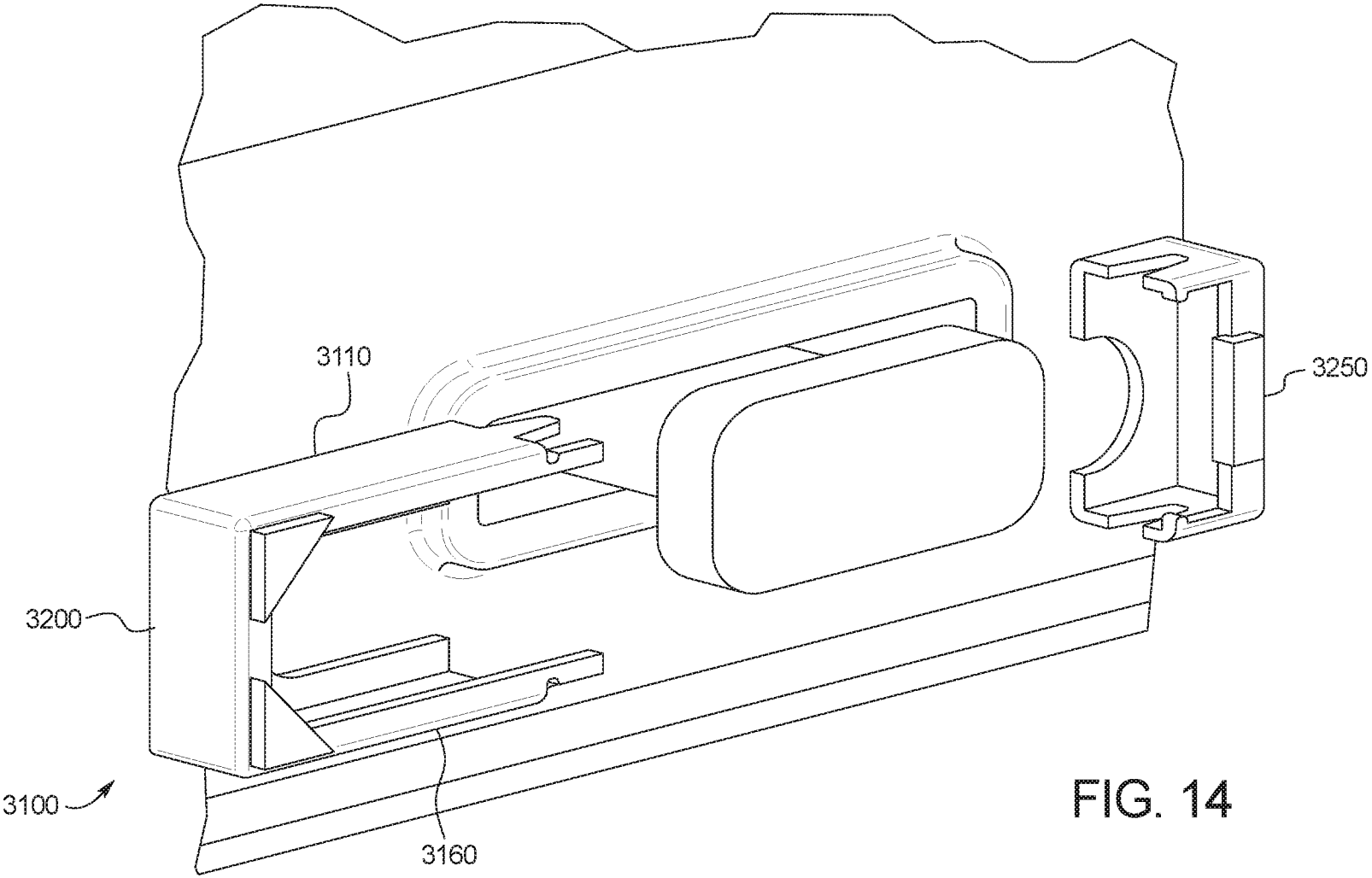
FIG. 14 is an exploded perspective view of another example embodiment of the draft key wear protector of the present disclosure shown adjacent to and prior to mounting on a head of a draft key.

Referring now to FIG. 14, another example embodiment of the draft key wear protector of the present disclosure is generally indicated by numeral 3100. This example draft key wear protector 3100 includes a generally rectangular body including: (1) a first arm 3110; (2) a second arm 3160 spaced-apart from the first arm 3110; (3) a first arm connector 3200 integrally connected to the first arm 3110 and integrally connected to the second arm 3160; and (4) a second detachable arm connector 3250 detachably connectable to the first arm 3110 and detachably connectable to the second arm 3160. In this illustrated example embodiment, the second detachable arm connector 3250 is not integrally connected to the first arm 3110 and the second arm 3160. In this illustrated example embodiment, the first arm 3110, the second arm 3160, the first arm connector 3200 and the second detachable arm connector 3250 are configured to partially or fully fit around the head of the draft key. The entire second detachable arm connector 3250 is configured to be quickly and easily attached to the first arm 3110 and the second arm 3160 when this example draft key wear protector 3100 is positioned on an un-installed draft key, and can be quickly and easily attached when this example draft key wear protector 3100 is to be positioned on an installed draft key. This illustrated example embodiment includes a suitable tongue in groove type attachment mechanism to securely reattach and lock the second arm connector 3250 to the first arm 3110 and the second arm 3160. It should be appreciated that any suitable attachment mechanism can be employed to reattach and lock the second arm connector 3250 to the first arm 3110 and the second arm 3160.

It should further be appreciated from the example of FIG. 14 that present disclosure contemplates other draft key wear protectors that have other suitable attachment configurations. For example, the arms can define aligned holes that enable attachment of a securing member (such as a clip or pin) to ensure connection of the arms to the draft key.

Figure 15:
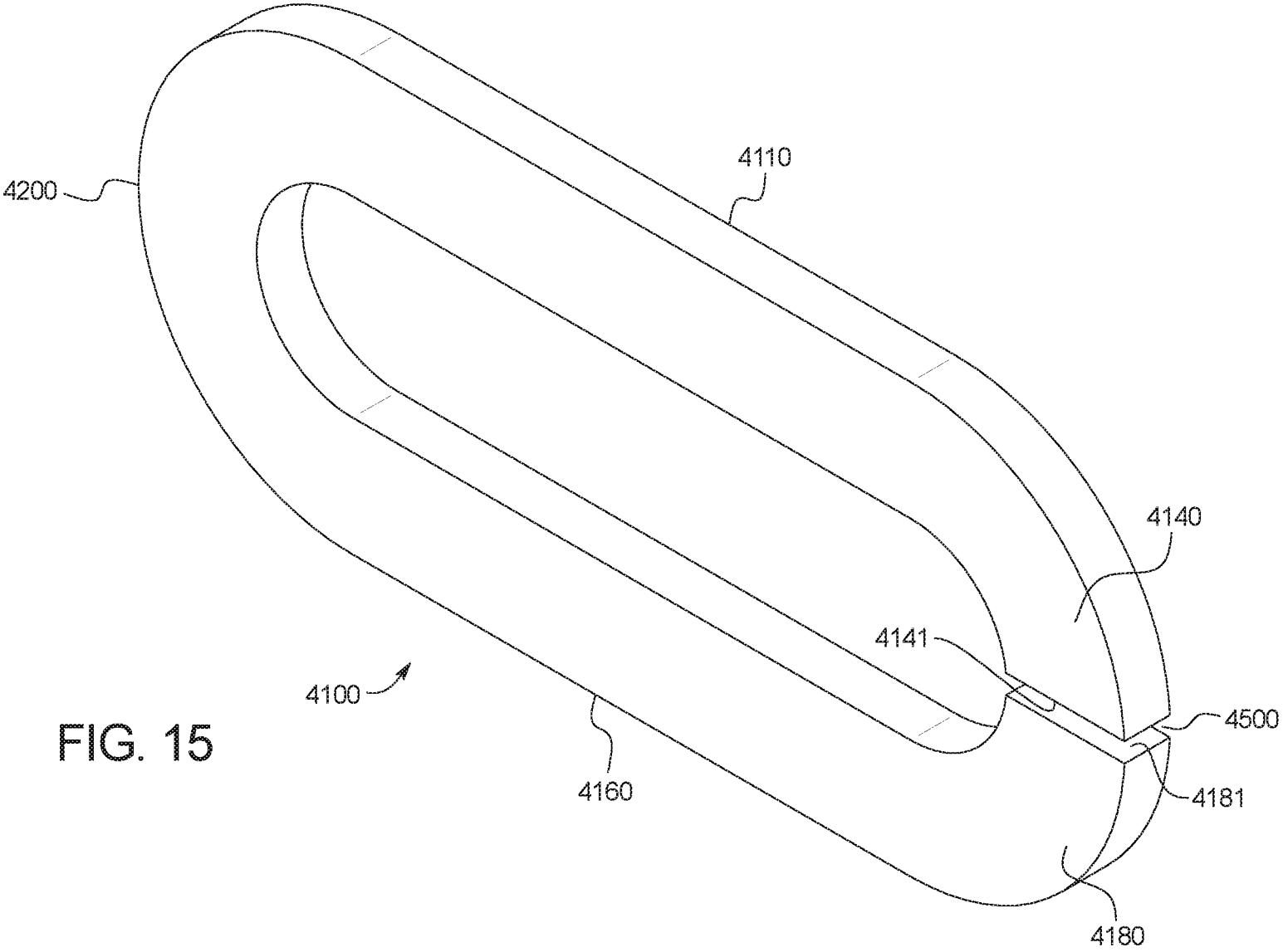
FIG. 15 is a perspective view of another example embodiment of the draft key wear protector of the present disclosure.

It should be appreciated that in further other example embodiments of the present disclosure, the draft key wear protector of the present disclosure does not include a detachable or attachable connector. Rather in certain of these alternative embodiments, the draft key wear protector includes or defines a space between the gripping hands of the arms of the draft key wear protector. For example, referring now to FIG. 15, another example embodiment of the draft key wear protector of the present disclosure is generally indicated by numeral 4100. This example draft key wear protector 4100 includes a generally oval body including: (1) a first arm 4110; (2) a second arm 4160 spaced-apart from the first arm 4110; and (3) a first arm connector 4200 integrally connected to the first arm 4110 and integrally connected to the second arm 4160. In this illustrated example embodiment, the first arm 4110 includes a gripping hand 4140 and the second arm 4160 includes a gripping hand 4180. These arms 4110 and 4160 and specifically these gripping hands 4140 and 4180 are spaced apart or define a space 4500 there between that enable these arms 4110 and 4160 and gripping hands 4140 and 4180 to be spread apart for mounting on an installed draft key. These arms 4110 and 4160 and specifically these gripping hands 4140 and 4180 define spaced apart surfaces or walls 4141 and 4181 that define the space 4500 there between.

It should be appreciated that the first arm 4110 and the second arm 4160 can alternatively have inclined or angled surfaces or walls (similar to draft key wear protector 100) that are configured to engage the body of the draft key during installation to assist in spreading the first and second arms 4110 and 4160 apart during installation of the draft key wear protector 4100 on the draft key.

It should also be appreciated that an additional securing mechanism (such as a clip or pin) can be employed with this example embodiment or any the above example embodiments to ensure that the draft key wear protector remains on the draft key.

It should also be appreciated that in additional embodiments of the present disclosure, the hands may include one or more additional locking mechanisms to lock the hands together after being installed on the draft key.

It should be appreciated from the above that various embodiments of the present disclosure provide a railroad car draft key wear protector comprising: a first arm; a second arm spaced-apart from the first arm; a first connector integrally connected to the first arm and integrally connected to the second arm; and a second connector integrally and detachably connected to the first arm and integrally and detachably connected to the second arm.

In various such embodiments of the railroad car draft key wear protector, the first arm includes a first elongated section, a first curved hand connected to and extending from one end of the first elongated section, and a second curved hand connected to and extending from a second opposite end of the first elongated section.

In various such embodiments of the railroad car draft key wear protector, the second arm includes a second elongated section, a first curved hand connected to and extending from one end of the second elongated section, and a second curved hand connected to and extending from a second opposite end of the second elongated section.

In various such embodiments of the railroad car draft key wear protector, the first connector includes a generally wedge shaped body integrally connected to the first arm and integrally connected to the second arm such that the first arm and the second arm are configured to be spread apart during installation of the draft key wear protector on an installed draft key.

In various such embodiments of the railroad car draft key wear protector, the detachable second connector includes a generally wedge shaped body.

In various such embodiments of the railroad car draft key wear protector, the detachable second connector is connected with the first arm by a first joint and to the second arm by a second joint.

In various such embodiments of the railroad car draft key wear protector, the first joint has a substantially narrower width than a width of the detachable second connector, and wherein the second joint has a substantially narrow width than the width of the detachable second connector.

In various such embodiments of the railroad car draft key wear protector, the first arm includes a first hand and the second arm includes a second hand, said first and second hands having inclined transversely extending surfaces.

It should also be appreciated from the above that various embodiments of the present disclosure provide a railroad car draft key wear protector comprising: a first arm having a first gripping hand; a second arm spaced-apart from the first arm and having a second gripping hand, said first gripping hand and said second gripping hand configured to engage a side of a body of a draft key when the first arm and the second arm are mounted on the draft key; and a first connector connected to the first arm at an end of the first arm opposite the first gripping hand, and connected to the second arm at an end of the second arm opposite the second gripping hand.

In various such embodiments of the railroad car draft key wear protector, the first connector includes a generally wedge shaped body integrally connected to the first arm and integrally connected to the second arm such that the first arm and the second arm are configured to be spread apart during installation of the draft key wear protector on an installed draft key.

In various such embodiments of the railroad car draft key wear protector, the first and second hands have spaced apart surfaces that define a space between the first and second hands.

In various such embodiments of the railroad car draft key wear protector, the first and second hands have spaced apart inclined surfaces that define a space between the first and second hands.

It should be appreciated from the above that various embodiments of the present disclosure provide a railroad car draft key wear protector comprising: a first arm including a first elongated section, a first hand connected to and extending from one end of the first elongated section, and a second hand connected to and extending from a second opposite end of the first elongated section; a second arm spaced-apart from the first arm, the second arm including a second elongated section, a first hand connected to and extending from one end of the second elongated section, and a second hand connected to and extending from a second opposite end of the second elongated section; a first connector integrally connected to the first hand of the first arm and integrally connected to the first hand of the second arm; and a second connector integrally connected to the second hand of the first arm and integrally connected to the second hand of the second arm, wherein the first arm is configured to engage a first side of a body of a draft key, the second arm is configured to engage a second side of the body of the draft key, the first connector is configured to engage a third side of the draft key, and the second connector is configured to engage a fourth side of the draft key.

In various such embodiments of the railroad car draft key wear protector, the first connector includes a generally wedge shaped body.

In various such embodiments of the railroad car draft key wear protector, the second connector includes a generally wedge shaped body.

In various such embodiments of the railroad car draft key wear protector, the second connector is detachably connected to the second hand of the first arm and detachably connected to the second hand of the second arm.

It will be understood that modifications and variations may be effected without departing from the scope of the novel concepts of the present invention, and it is understood that this application is to be limited only by the scope of the claims.

The invention is claimed as follows:

1. A vehicle draft key wear protector comprising:

a first arm;

a second arm spaced-apart from the first arm;

a first connector integrally connected to the first arm and integrally connected to the second arm, and the first connector allows the first and second arms to bias outwardly when the first and second arms pass over a draft key; and a second connector integrally and detachably connected to the first arm and integrally and detachably connected to the second arm.

2. The vehicle draft key wear protector of claim 1, wherein the first connector includes a generally wedge shaped body integrally connected to the first arm and integrally connected to the second arm such that the first arm and the second arm are configured to be biased apart during installation of the vehicle draft key wear protector on an installed draft key.

3. The vehicle draft key wear protector of claim 1, wherein the detachable second connector includes a generally wedge shaped body, and the wedge shaped body engages a surface of the first arm and a surface of the second arm.

4. The vehicle draft key wear protector of claim 3, wherein the detachable second connector is connected with the first arm by a first joint and to the second arm by a second joint.

5. The vehicle draft key wear protector of claim 4, wherein the first joint has a substantially narrower width than a width of the detachable second connector, and wherein the second joint has a substantially narrower width than the width of the detachable second connector.

6. The vehicle draft key wear protector of claim 1, wherein the first connector allows the first arm and the second arm to return to an unbiased position after passing a draft key.

7. The vehicle draft key wear protector of claim 6, wherein the first arm and the second arm each have an inclined surface and the inclined surfaces engage the draft key during installation to bias the first and second arms outward.

8. The vehicle draft key wear protector of claim 6, wherein the inclined surfaces engage with the second connector when the second connector is attached.

9. The vehicle draft key wear protector of claim 1, wherein the first arm and the second arm are positioned between a draft key head and a sill or frame component.

10. A vehicle draft key wear protector comprising:

a first arm having a first gripping hand;

a second arm spaced-apart from the first arm and having a second gripping hand, said first gripping hand and said second gripping hand configured to engage a side of a body of a draft key when the first arm and the second arm are mounted on the draft key;

the first arm and the second arm positioned between a draft key head and a sill or frame component; and a first connector connected to the first arm at an end of the first arm opposite the first gripping hand, and connected to the second arm at an end of the second arm opposite the second gripping hand, and the first and second gripping hands have spaced apart inclined surfaces that engage with an installed draft key to bias first and second arm outward.

11. The vehicle draft key wear protector of claim 10, wherein the first connector includes a generally wedge shaped body integrally connected to the first arm and integrally connected to the second arm, and the first connector configured such that the first arm and the second arm are biased apart as the first and second arms pass over an installed draft key.

12. The vehicle draft key wear protector of claim 10, wherein the first connector allows the first arm and the second arm to return to an unbiased position after passing over an installed draft key.

13. The vehicle draft key wear protector of claim 10, wherein the second connector comprises a first joint that engages with the first arm and a second joint that engages with the second arm.

14. A vehicle draft key wear protector comprising:

a first arm including a first elongated section, a first hand connected to and extending from one end of the first elongated section, and a second hand connected to and extending from a second opposite end of the first elongated section;

a second arm spaced-apart from the first arm, the second arm including a second elongated section, a first hand connected to and extending from one end of the second elongated section, and a second hand connected to and extending from a second opposite end of the second elongated section;

the first arm and the second arm positioned between a draft key head and a sill or frame component;

a first connector integrally connected to the first hand of the first arm and integrally connected to the first hand of the second arm; and a second connector integrally connected to the second hand of the first arm and integrally connected to the second hand of the second arm and the second connector detachable from the first and second arms to form a gap between the first and second arms, wherein the first arm is configured to engage a first side of a body of a draft key, the second arm is configured to engage a second side of the body of the draft key, the first connector is configured to engage a third side of the draft key, and the second connector is configured to engage a fourth side of the draft key.

15. The vehicle draft key wear protector of claim 14, wherein the first connector includes a generally wedge shaped body and a first surface of the wedge shaped body engages with the first arm and a second surface of the wedge shaped body engages with the second arm.

16. The vehicle draft key wear protector of claim 15, wherein the second connector includes a generally wedge shaped body and forms a wedge shaped gap when detached.

17. The vehicle draft key wear protector of claim 14, wherein when the second connector is detached, inclined surfaces of the first arm and the second arm are exposed, and the inclined surfaces engage a draft key to bias the first and second arms outward during installation of the vehicle draft key wear protector.

* * * * *